US005443195A

United States Patent [19]

Sinn

[11] Patent Number: 5,443,195

[45] Date of Patent: Aug. 22, 1995

[54] DEVICE FOR REMOVING KNOCKOUTS, SUCH AS SCRAP, FROM A SHEET OF MATERIAL CONTAINING BLANKS OR SIMILAR

[75] Inventor: Rolf Sinn, Leingarten, Germany

[73] Assignee: Karl Marbach GmbH Co., Germany

[21] Appl. No.: 129,981

[22] Filed: Sep. 30, 1993

[51] Int. Cl.[6] ..... B26D 7/18

[52] U.S. Cl. ..... 225/104; 225/96

[58] Field of Search ..... 225/103, 104, 94, 96, 225/2; 83/686, 689

[56] References Cited

U.S. PATENT DOCUMENTS

| | | | |
|---|---|---|---|
| 2,369,896 | 2/1945 | Harris et al. | 83/686 |
| 2,816,608 | 12/1957 | Farmwald et al. | 83/686 |
| 3,130,885 | 4/1964 | Fleming | 83/689 |
| 3,670,610 | 6/1972 | Cady, Jr. | 83/686 |
| 3,863,531 | 2/1975 | Forschner et al. | 83/689 |
| 3,996,832 | 12/1976 | Schubert et al. | 83/686 |

FOREIGN PATENT DOCUMENTS

| | | | |
|---|---|---|---|
| 0592179 | 7/1925 | France | 83/689 |
| 2631117 | 1/1978 | Germany | 83/689 |
| 9003329 | 8/1990 | Germany . | |
| 0161613 | 6/1962 | U.S.S.R. | 83/689 |

OTHER PUBLICATIONS

Pp. 34–36 of the Dec. 1990 isue of Papier+Kunststoff-Verarbeiter Article titled "Ausbrechen, unten ohne".

*Primary Examiner*—Kenneth E. Peterson
*Attorney, Agent, or Firm*—Woodard, Emhardt, Naughton, Moriarty & McNett

[57] ABSTRACT

A device for removal of knockouts from a material sheet has a support plate for the material sheet having openings with continuous vertical walls. Each knockout overlaps the pertaining opening resting with its marginal bearing surfaces on the support plate. Knockout tools with vertical and horizontal narrow sides on a tool holder plate movable toward and away from the support plate are so arranged that their disposition is essentially vertical to the coordinated knockout and symmetric as regards the bearing surfaces. Each knockout tool on its support plate side features at least one point as an end of the one vertical narrow side. The angle between the point and the face extending from the point to the adjacent horizontal narrow side ranges from 20° to 50° projected in the side center plane.

20 Claims, 2 Drawing Sheets

DEVICE FOR REMOVING KNOCKOUTS, SUCH AS SCRAP, FROM A SHEET OF MATERIAL CONTAINING BLANKS OR SIMILAR

The invention concerns a device for removal of knockouts, such as scrap, from a sheet of material containing blanks or the like. The device has a support plate for the material sheet, in which plate there are openings provided. Each knockout overlaps the pertaining opening. The marginal bearing surfaces of each knockout have an arrangement of essentially planar or axial symmetry relative to the pertaining opening. Additionally provided is a tool holder plate which vertically is movable toward and away from the support plate. Arranged on the holder plate are knockout tools which protrude toward the support plate and consist of rectangular steel strip pieces with vertical and horizontal narrow sides. Each knockout tool is arranged essentially vertically to the pertaining knockout and symmetrically relative to the bearing surfaces of the coordinated knockout.

Figure 1:
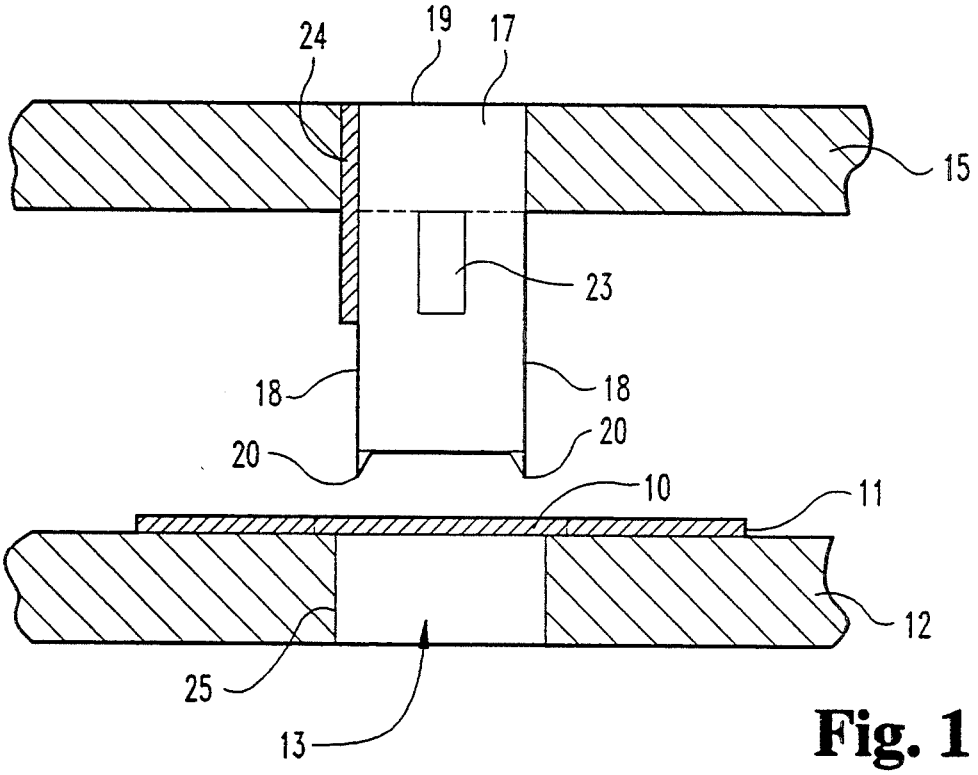

Such a device has been described in DE-GM 90 03 329.9 (FIG. 1, 2).

It has been demonstrated that with a device of such design it is not possible to dependably remove all knockouts, since it happens that an attachment point fails to tear off in the knockout process, with the knockout tool merely pushing the knockout obliquely downward into the support plate opening, and with the knockout then being pulled out of the opening again in the further feed of the sheet of material.

To avoid this, DE-GM 90 03 329.9 proposes using rotationally symmetric pins with points as knockout tools and coordinate with the openings elastic buttresses which protrude into their interior. As the points of the pins sink into the coordinated knockout and force it down into the pertaining opening, the knockout simultaneously forces the elastic buttress downward, which then, as the knockout pin retracts into its rest position, strips the knockout off. It has been shown that the elastic buttresses are very susceptible to wear, requiring frequent replacement. Besides, due to the arrangement of the buttresses, the structure of the support plate is being complicated. Moreover, the fabrication of the rotationally symmetric, pointed knockout pins is relatively expensive.

The problem underlying the invention, therefore, consists in fashioning the device of the categorial type in such a way that a safe and dependable knockout action and removal of the knockouts is guaranteed with a simple design.

Basing on the device of the initially named type, this problem is solved in that the knockout tool of steel strip features on the support plate side at least one point, that the point is arranged in the center of the one vertical narrow side of the knockout tool of steel strip, and that the angle between the vertical narrow side featuring the point and the surface extending from the point to the adjacent horizontal narrow side of the knockout tool that faces toward the support plate ranges in the narrow side center plane of the knockout tool from 20° to 50°. Favorably, this angle ranges from 25° to 40°. Preferred is a 30° angle.

The inventional device is simple in its structure, requires merely to fashion a point in the inventional manner, at the end of one narrow side of a knockout tool of steel strip known as such. Owing to its inventional design, the point cannot slip as the knockout bends as it is pushed into the opening, so that a cut-in and puncturing is assured. Thus, the knockout bulges elastically in the opening. Upon leaving the opening, it assumes again its original flat shape spontaneously, due to the elastic restoring forces, whereby it is safely thrown off the point. Hence, there are no strippers needed in the support plate.

This effect is augmented yet if the surface extending from the point to the horizontal narrow side of the steel strip knockout tool facing toward the support plate has the shape of an equilateral triangle whose apex angle is 30° to 90°, preferably 60°. The grinding may be such that slanted flanks are formed, sideways of this surface up to the level of the horizontal narrow side. But it is also possible to let the respective bevel extend along the vertical narrow side so that, starting from the point, it forms a sharp edge.

In the case of paper and cardboard materials used for customary blanks of boxes and cartons, the vertical spacing of the point from the adjacent horizontal narrow side of the knockout tool from steel strip amounts usually to 0.5–2.5 mm, preferably 1.5 mm. To simplify assembly and assure proper positioning during operation, a stop is provided on the knockout tool of steel strip, which knockout engages the tool holder plate and may consist, e.g., of a part obtained by incision into and bending out of the steel strip or by punch-out.

A positionally safe arrangement with regard to the tool holder plate is guaranteed by providing on the knockout tool end on the near side of the tool holder plate, along a vertical narrow side, a locating flange of steel strip at an angle of 90°, which flange may be made also by appropriate bending of the steel strip. The locating flange enables also a stable retention of the knockout tool in the tool holder plate.

The openings in the inventional device have relative to the bearing surface of the support plate continuous vertical walls, which greatly simplifies the fabrication of the support plate.

For the aforementioned paper and cardboard materials customarily used, a horizontal spacing between the vertical narrow side of the knockout tool from steel strip featuring the point and the coordinated, vertically continuous inside wall of the opening in the order of 2 to 10 times the material thickness has proved to be particularly advantageous. In practice, this spacing is usually 2 to 5 mm.

Figure 2:
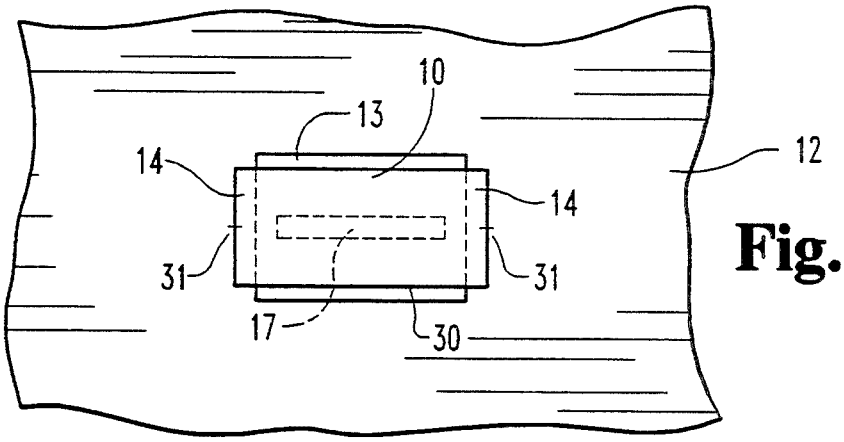
Figure 3:
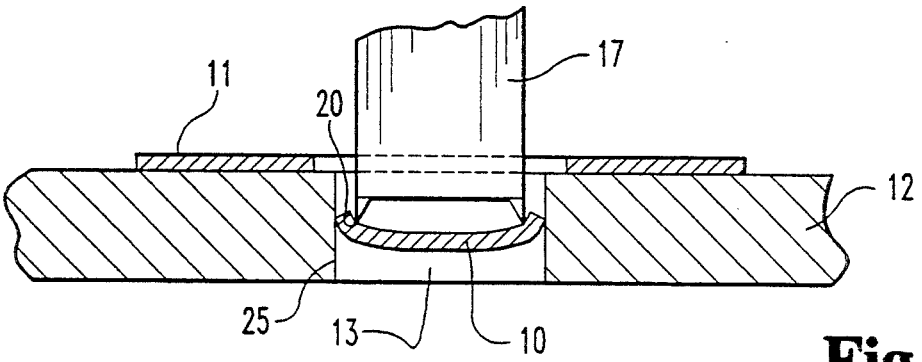
Figure 4:
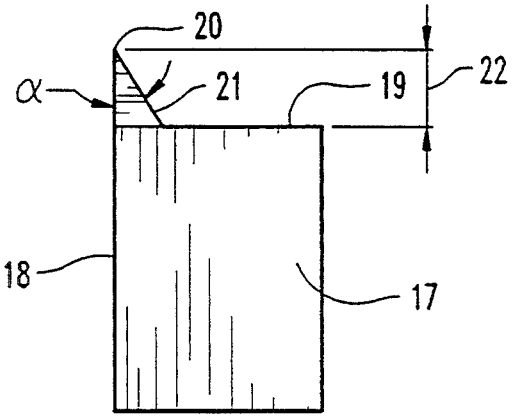
Figure 6:
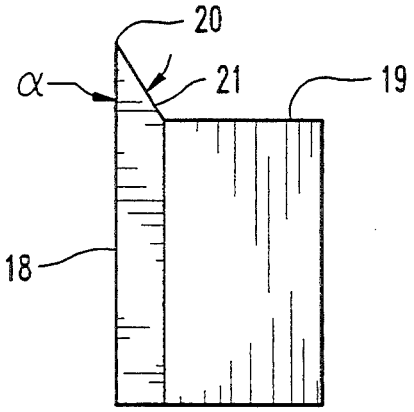
Figure 5:
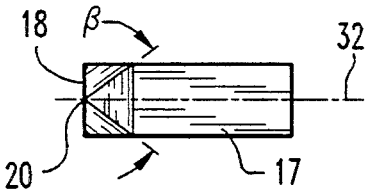
Figure 7:
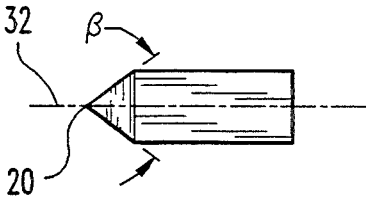
Figure 8:
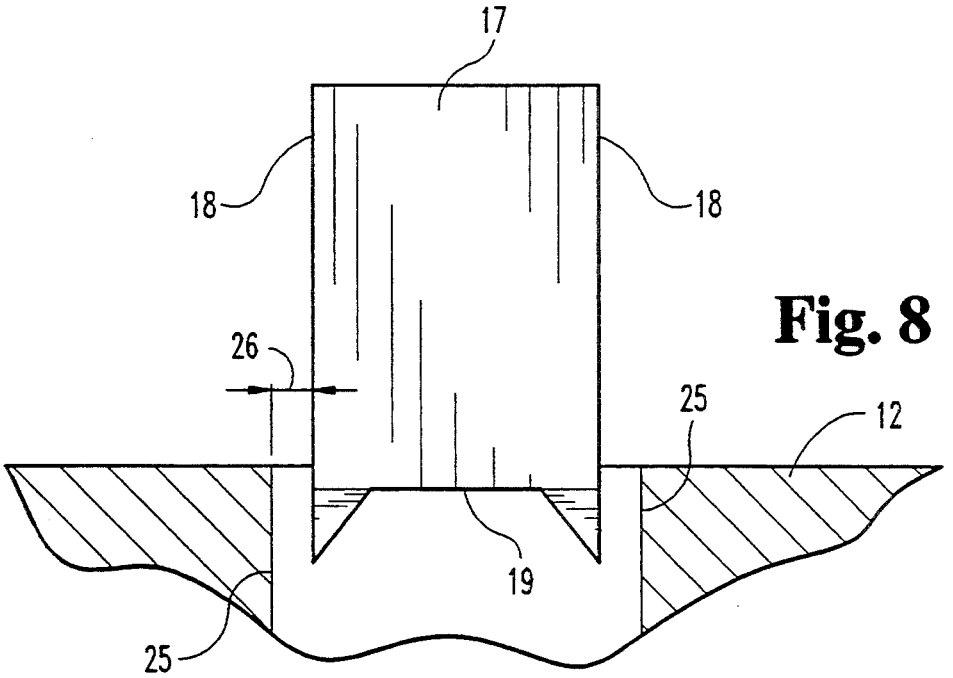
Figure 9:
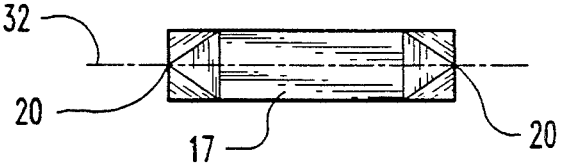

Embodiments of the invention are more fully explained with the aid of drawings showing in FIG. 1, schematically, a partial view of the device in longitudinal section;

FIG. 2, a plan view of the support plate relative to FIG. 1;

FIG. 3, a view as in FIG. 1, the support plate with a partially lowered knockout tool;

FIG. 4, a knockout tool with a point in side elevation;

FIG. 5, a plan view of the knockout tool relative to FIG. 4;

FIG. 6, a knockout tool modified as compared to FIG. 4;

FIG. 7, a plan view of the knockout tool relative to FIG. 6;

FIG. 8, as an enlarged detail, the relationship between the knockout tool and the wall of the opening in the support plate; and FIG. 9, a bottom view of the knockout tool relative to FIG. 8.

The device shown in FIG. 1 has a horizontal tool holder plate 15 and, spaced from it, a horizontally arranged support plate 12 on which a material sheet 11 of paper or cardboard is arranged positionally fixed, which sheet was previously processed in a not illustrated stamping and corrugating device for the manufacture of blanks, with a knockout 10 being cut out on its periphery along edges 30 and held by way of small retaining points 31, which in FIG. 2 are shown exaggerated. The knockout 10 is arranged over an opening 13 in the support plate 12 which has continuous vertical walls 25, in such a way that the knockout rests with bearing surfaces 14 on the side of the retainers 31 on the support plate 12, whereas on the two other sides the opening 13 is greater than the transverse expanse of the knockout 10.

A knockout tool 17 of steel strip is fixed in the tool holder plate 15. The exact position of the knockout tool 17 is fixed in that it has in its section near the tool holder plate a locating flange 24 which is rectangular to it. This positional accuracy is accomplished in that the incisions to be provided for fixing the knockout tool 17 in the tool holder plate 15 are usually made employing laser technology. The knockout tool 17 of steel strip has vertical narrow sides 18 and horizontal narrow sides 19, the one horizontal narrow side 19 being in alignment with the backside of the tool holder plate 15 after assembly. Arranged on the knockout tool 17, moreover, is a stop 23 which engages the surface of the tool holder plate 15 facing toward the support plate 12. The stop 23 may be formed by incision or bend-out of steel strip material of the knockout tool 17. For one, the stop 23 contributes to an exact level positioning of the knockout tool 17 and, during operation, prevents the knockout tool 17 from being pushed through the tool holder plate 15.

As follows from FIG. 4 through 7, each knockout tool has a point 20 in the center, on the end of the one vertical narrow side 18 of the knockout tool 17 of steel strip. This point 20 extends via an inclined surface 21 into the horizontal narrow side 19. The angle $\alpha$ between the inclined surface 21 and the vertical narrow side 18, in the illustrated embodiment, amounts to 30°, projected on the narrow side center plane 32. As is evident from FIG. 5, the inclined surface 21 has the shape of an equilateral triangle with two identical base angles and an apex angle $\beta$ of 45° in the illustrated embodiment. The spacing between the horizontal narrow side 19 and the point 20 of the knockout tool 17 of steel strip is referenced 22 and amounts to 0.5 to 2 times the material thickness.

In the embodiment according to FIG. 4 and 5, the point 20 is of a design such that slanted flanks extend from the inclined surface 21 to the horizontal narrow side 19 and the vertical narrow side 18. In the embodiment according to FIG. 6 and 7, these flanks are nonexistent, so that the narrow side 18 is a sharp edge that extends into the point 20.

Depending on the knockout 10 to be removed, the knockout tools 17 are so fashioned that a symmetric knockout force will be exerted on the knockout 10, which force is symmetric also relative to the retaining points 31.

For the rectangular knockout 10 illustrated in FIG. 1 and 2, the knockout tool 17 is so arranged that its narrow side center plane 32 (FIG. 7) coincides with the joining plane of the two opposite retaining points 31 and the distance from these retaining points 31 and the vertical continuous walls 25 of the pertaining opening 13 is the same. In FIG. 8, this distance is referenced 26. It amounts to 3 to 10 times the material thickness.

The knockout tool 17 shown in FIG. 8 and 9 has two points 20, which is shown also in FIG. 1 through 3, and at that, always on the end of the vertical narrow side 18.

As follows from FIG. 3, the points 20 of the knockout tool 17 being moved in the direction of double arrow 16 with a pertaining tool holder plate 15 toward the support plate 12 sink into the knockout 10. Owing to this design, slippage of the point 20 is not possible. The retaining points 31 break in the process, and the knockout 10 bulges downward and it pushed through the opening 13 with its continuous, vertical walls 25. As the edges of the knockout 10 bearing sideways on the vertically continuous walls 25 of the opening 13 leave the latter, the restoring forces of the knockout 10 allow it to snap back to its essentially flat starting shape, whereby the knockout 10 is thrown off the points 20 and drops under the effect of gravity.

I claim:

1. A device for removal of a knockout from a material sheet containing a blank, said blank having marginal bearing surfaces, comprising:

a material sheet containing a blank;

a support plate defining an opening, said support plate adapted to support said material sheet over said opening with said knockout overlapping said opening and said marginal bearing surfaces symmetrically disposed relative to said opening;

a tool holder plate operably associated with said support plate and capable of vertical movement towards and away from said support plate; and a knockout tool having vertical and horizontal narrow sides disposed about a side center plane, said knockout tool fixed to said tool holder plate and extending towards said support plate, said knockout tool being arranged vertically relative to said knockout and symmetrically disposed relative to said marginal bearing surfaces of said knockout, said knockout tool including at least one point extending from one of said horizontally disposed sides towards said support plate, said point being disposed on one of said vertical narrow sides of said knockout tool aligned with said side center plane, said knockout tool having an inclined surface extending from said point to said one of said horizontal narrow sides, said inclined surface and said one of said narrow vertical sides forming an angle alpha in a range from 20°–50°, and wherein said material sheet has a material thickness and said vertical narrow side wall of said knockout tool featuring said point is horizontally spaced apart from an opposed one of said vertical walls of said opening a distance greater than about 2 times said material thickness.

2. The device of claim 1 wherein said inclined surface has the shape of a triangle having at least two equal sides and an apex angle beta in a range from 30°–90°.

3. The device of claim 2 wherein said inclined surface has the shape of a triangle having at least two equal sides and having an apex angle beta of approximately 60°.

4. The device of claim 3 wherein said material sheet has a material thickness and said point is spaced apart from said one of said horizontal narrow sides a distance equal to approximately 0.5 to 6 times said material thickness.

5. The device of claim 4 and further comprising a stop fixed to and extending from said knockout tool and engaging said tool holder plate.

6. The device of claim 5 and further comprising a locating flange fixed to and extending from said knockout tool and adapted to locate the position of said knockout tool in said tool holder plate.

7. The device of claim 6 wherein said opening in said support plate is defined by continuous vertical walls.

8. The device of claim 7 wherein said material sheet has a material thickness and said vertical narrow side wall of said knockout tool featuring said point is horizontally spaced apart from an opposed one of said vertical walls of said opening a distance about 2 to 10 times said material thickness.

9. The device of claim 8 wherein said angle alpha is in the range from 20°–40°.

10. The device of claim 1 wherein said opening in said support plate is defined by continuous vertical walls, 11. The device of claim 1 wherein said angle alpha is in a range from 20°–40°.

12. The device of claim 10 wherein said angle alpha is approximately 30°.

13. The device of claim 1 and further comprising a stop fixed to and extending from said knockout tool and engaging said tool holder plate.

14. The device of claim 1 wherein said inclined surface has the shape of a triangle having at least two equal having an apex angle beta of approximately 60°.

15. The device of claim 1 wherein said material sheet has a material thickness and said point is spaced apart from Said one of said horizontal narrow sides a distance equal to approximately 0.5 to 6 times said material thickness.

16. The device of claim 15 wherein said opening in said support plate is defined by continuous vertical walls.

17. The device of claim 16 wherein said material sheet has a material thickness and said vertical narrow side wall of said knockout tool featuring said point is horizontally spaced apart from an opposed one of said vertical walls of said opening a distance about 2 to 10 times said material thickness.

18. The device of claim 15 wherein said point is spaced apart from said one of said horizontal narrow sides a distance equal to approximately 0.5 to 2 times said material thickness.

19. The device of claim 1 and further comprising a locating flange fixed to and extending from said knockout tool and adapted to locate said knockout tool in said tool holder plate.

20. The device of claim 19 wherein said vertical narrow side wall of said knockout tool featuring said point is horizontally spaced apart from an opposed one of said vertical walls of said opening a distance about 2 to 10 times said material thickness.

* * * * *

UNITED STATES PATENT AND TRADEMARK OFFICE

CERTIFICATE OF CORRECTION

PATENT NO. : 5,443,195

DATED : August 22, 1995

INVENTOR(S) : Rolf Sinn

It is certified that error appears in the above-indentified patent and that said Letters Patent is hereby corrected as shown below:

In column 6, line 2, following the word "equal" please insert --sides--.

Signed and Sealed this

Thirty-first Day of October 1995

*Attest:*

BRUCE LEHMAN

*Attesting Officer*

*Commissioner of Patents and Trademarks*